United States Patent [19]

Sykora

[11] 4,042,795

[45] Aug. 16, 1977

[54] SLIDE SWITCH CONTACT HAVING PLURAL FLEXIBLE SLATS PROVIDING MAKE BEFORE BREAK CONTACT ENGAGEMENT

[75] Inventor: Allan J. Sykora, Cary, N.C.

[73] Assignee: Stackpole Components Company, Raleigh, N.C.

[21] Appl. No.: 700,393

[22] Filed: June 28, 1976

[51] Int. Cl.[2] ..... H01H 15/00; H01H 1/50

[52] U.S. Cl. ..... 200/16 D; 200/252; 200/275

[58] Field of Search ..... 200/16 C, 16 D, 11 G, 200/11 J, 11 K, 252–261, 275

[56] References Cited

U.S. PATENT DOCUMENTS

| | | | |
|---|---|---|---|
| 3,072,757 | 1/1963 | Gluck | 200/16 D |
| 3,261,928 | 7/1966 | Schlesinger, Jr. | 200/16 D X |
| 3,270,149 | 8/1966 | O'Shea et al. | 200/16 C |
| 3,485,966 | 12/1969 | Bailey et al. | 200/16 D |
| 3,546,402 | 12/1970 | Spaeth et al. | 200/16 D |

*Primary Examiner*—James R. Scott

*Attorney, Agent, or Firm*—Brown, Murray, Flick & Peckham

[57] ABSTRACT

In an electric switch a slide containing a shorting contact is movable back and forth along a row of at least three fixed electric contacts. The shorting contact is formed from a spring metal strip having an elongated central body between a pair of end portions, the body having contact surface for sliding engagement with the fixed contacts and being long enough to bridge three of them simultaneously. The end portions of the shorting contact extend toward the back wall of the contact-receiving recess in the slide and toward each other to form inclined legs having free ends pressing against the slide to press the contact surface against the fixed contacts. The central body of the shorting contact is provided with at least one slot extending lengthwise of it and into its legs to separate the body into laterally spaced contact bands integrally connected at the free ends of the legs. These bands, in their unstressed condition before the shorting contact is inserted in the slide recess, are bowed lengthwise toward the inclined legs.

8 Claims, 5 Drawing Figures

SLIDE SWITCH CONTACT HAVING PLURAL FLEXIBLE SLATS PROVIDING MAKE BEFORE BREAK CONTACT ENGAGEMENT

BACKGROUND OF THE INVENTION

A slidable shorting contact performs a make-before-break function. Assuming three fixed contacts a, 2 and 3 and that the shorting contact is bridging contacts 1 and 2, when the shorting contact is moved toward contact 3, it must engage it before separating from contact 1. In other words, make-before-break is considered to be shorting. A problem with switches provided with shorting contacts is one of reliability. That is, sometimes they work and sometimes they do not. The sliding contact may separate from the first fixed contact before engaging the third fixed contact, or the sliding contact may not make good contact with all of the fixed contacts. Such shorting contacts known heretofore have a solid central body portion that engages the fixed contacts. The body portion has been either normally flat or bowed lengthwise toward the base member that carries the fixed contacts.

OBJECTS OF THE INVENTION

It is an object of this invention to provide an electric slide switch a shorting contact of such construction that it can be depended upon to always perform its shorting function. Another object is to provide such a shorting contact which is of simple and inexpensive form and self-biasing against the fixed contacts.

BRIEF DESCRIPTION OF THE DRAWINGS

The preferred embodiment of the invention is illustrated in the accompanying drawings, in which.

DESCRIPTION OF THE PREFERRED EMBODIMENTS

Figure 1:
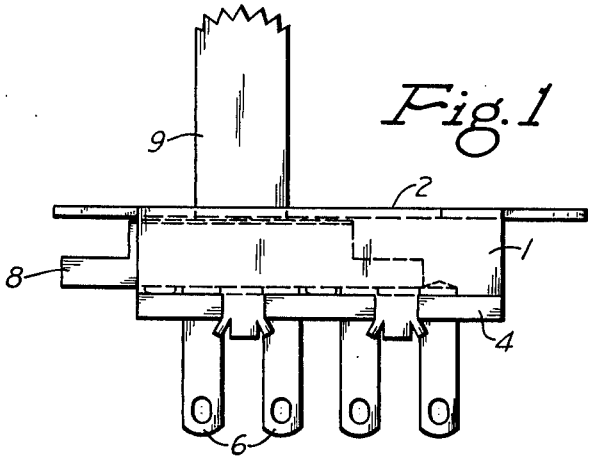
FIG. 1 is a side view of the switch.
Figure 2:
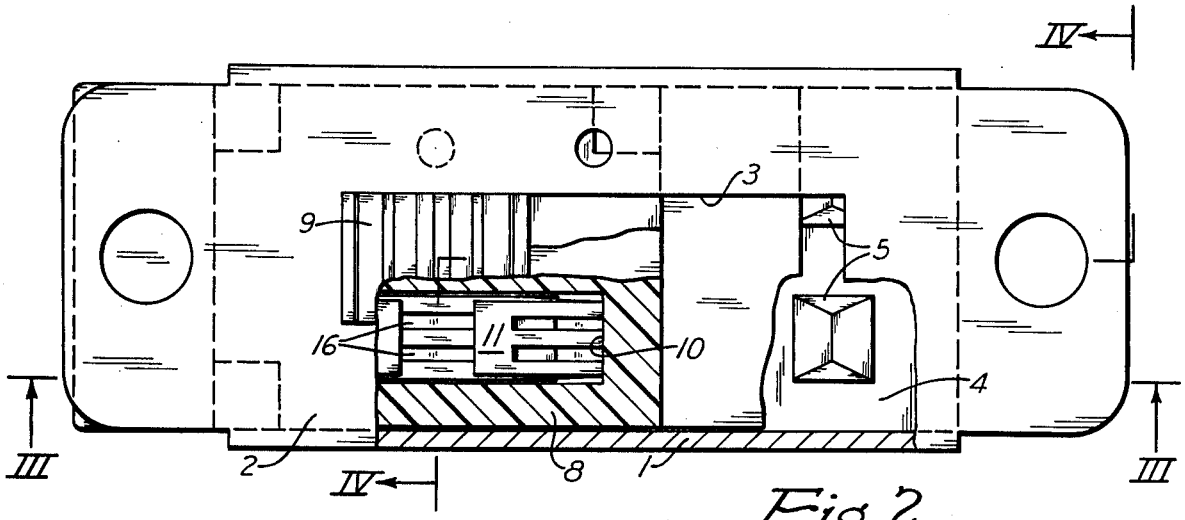
FIG. 2 is an enlarged plan view, partly broken away.
Figure 3:
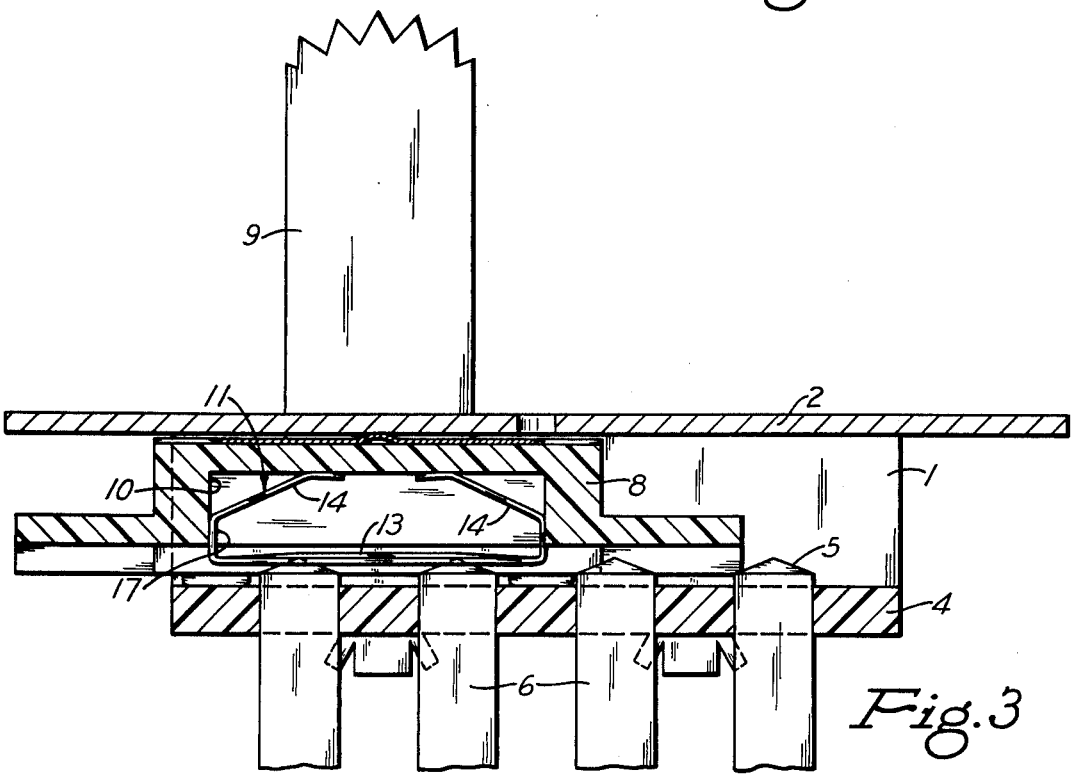
FIG. 3 is a longitudinal section taken on the line III—III of FIG. 2.

Referring to FIGS. 1 to 4 of the drawings, a metal channel has parallel side walls 1 connected by a top wall 2 provided with a slot 3 extending lengthwise of the channel. Parallel to the top wall of the channel, but spaced from it, is a flat insulating base 4 rigidly mounted against the free edges of side walls 1, whereby a switch housing is formed. The insulating base supports at least one row of at least three fixed electric contacts 5, as shown in FIG. 3. The contacts are on the upper or inner surface of the base and are integral with terminals 6 that extend through the base, in which the terminals are rigidly mounted. Each of the fixed contacts preferably has a substantially flat top extending transversely of the insulating base, and sides diverging from the ends of its flat top toward the base.

Figure 4:
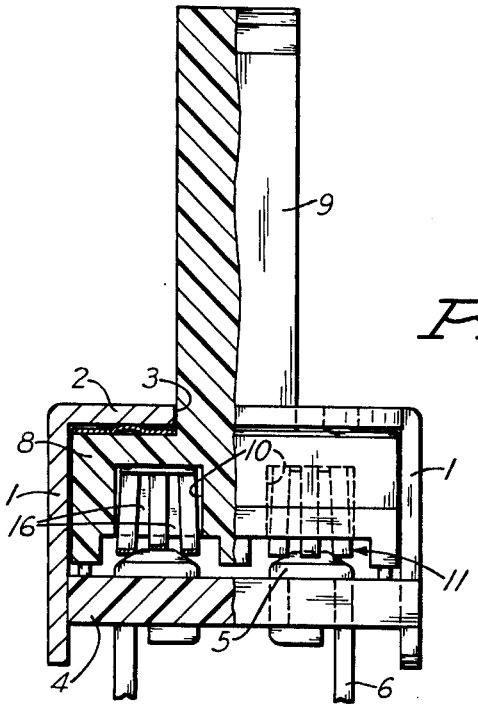
FIG. 4 is a cross section taken on the line IV—IV of FIG. 2.

Slidably mounted inside the housing is a slide 8 made of insulating material. This slide straddles the rows of fixed contacts and can be moved back and forth along the base manually by a button 9 extending from the center of the slide out through the slot in the top of the housing. The inner face of the slide facing the fixed contacts is provided with parallel recesses 10 that extend lengthwise of the base. Each recess is centered over one of the rows of contacts, as shown in FIG. 4. Disposed in each recess is a shorting contact 11 that is movable back and forth along the underlying row of fixed contacts by means of the slide.

Figure 5:
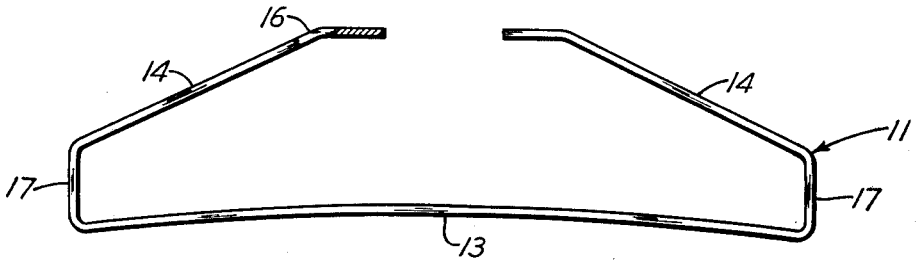
FIG. 5 is an enlarged side view of the shorting contact before insertion in the switch.

Each shorting contact is formed from a spring metal strip having an elongated central body 13 between a pair of end portions, as shown in FIGS. 3 and 5. The central body has a bottom contact surface for sliding engagement with the fixed contacts beneath it and it is long enough to bridge three fixed contacts simultaneously. The end portions of the shorting contact extend toward the back wall of the slide recess and toward each other to form legs 14 inclined to the central body, with their free ends pressing against the back wall of the recess to press the contact surface of the shorting contact against the fixed contacts. The switch construction described thus far is not novel.

On the other hhand, it is a feature of this invention that the shorting contact is formed in such a novel manner as to overcome the disadvantges of known shorting contacts. Accordingly, the central body of the shorting contact is provided with at least one slot 16 through it extending lengthwise of the switch and into the inclined legs of the contact, as shown in FIGS. 2 and 4. Preferably, the end portions of the contact include substantially parallel sections 17 integrally connecting the ends of the central body with the inclined legs. By making sections 17 parallel to each other, recess 10 in slide 8 can be shorter than would be the case if the end sections were curved as in conventional contacts of this general type, since curved ends require a longer contact. Slot 16 extends through parallel sections 17 and extends into each of the inclined legs 14 a distance equal to more than half the length of the legs. The slot separates the central body 13 into spaced contact bands that are integrally connected at the unslotted free ends of the legs.

Although only one slot can be used, it is preferred to form two parallel slots so that three contact bands will be provided. The central band engages the flat tops of the fixed contacts while the side bands engage the diverging sides of the fixed contacts. The pressure of the bands against the fixed contacts will generally cause the side bands to spread farther away from the central band, as shown in FIG. 4. The diverging sides of the fixed contacts will be engaged only the inner edges of the outer bands. Since there are three bands, the central band will not always lie in the same plane as the side bands and may at times move lengthwise relative to the side bands.

Another feature of this invention is that the shorting contact is so formed that in its unstressed condition before insertion in the switch, the central body 13 of the contact is bowed lengthwise towards its inclined legs, as shown in FIG. 5. Then, when the contact is inserted in the switch, the pressure of the slide aginst the contact will cause the contact bands to straighten out and bear with substantially equal pressure against the three fixed contacts being shorted. If the bands were straight initially, or if they were bowed in the opposite direction, it has been found that their contact with the fixed contacts is not dependable, for the ends of the bands may left away from the fixed contacts at times. With two or three contact bands that can flex independently of each other, there are more points of contact than heretofore between the sliding contact and the fixed contacts, so if for any reason one band happens to fail to engage one of the fixed contacts, there will be one or two other bands making the contact and the current will flow through all of the integrally connected bands.

According to the provisions of the patent statues, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An electric slide switch comprising a row of at least three fixed electric contacts, a slide movable back and forth along said row and having a recess therein facing the contacts and extending lengthwise of said row, and a shorting contact disposed in said recess and movable by the slide along the row of fixed contacts, said shorting contact being formed from a spring metal strip having an elongated central body between a pair of end portions, said body having a contact surface for sliding engagement with the fixed contacts and being long enough to bridge three fixed contacts simultaneously, said end portions extending toward the back wall of said slide recess and toward each other to form legs inclined to said body with their free ends pressing against said back wall to press said contact surface against the fixed contacts, said central body being provided with at least one slot extending the full length thereof and into said legs to separate said body into laterally spaced contact bands integrally connected at said free ends of said legs, and said bands being bowed lengthwise toward said legs before the shorting contact is inserted in the slide recess.

2. An electric slide switch according to claim 1, in which said slot extends into each of said legs a distance equal to more than half the length of the leg.

3. An electric slide switch according to claim 1, in which the end portions of the shorting contact include substantially parallel sections integrally connecting the ends of said central body with said inclined legs.

4. An electric slide switch according to claim 1, in which each of said fixed contacts is tapered transversely of said contact bands toward said slide, whereby to provide each fixed contact with sloping sides, and each of said sloping sides being engageable by only one of said contact bands.

5. An electric slide switch according to claim 1, in which there are two of said slots disposed in parallel relation to form three of said bands.

6. An electric slide switch according to claim 5, in which each of said fixed contacts has a substantially flat top extending transversely of the central contact band and engageable only by it, each of the fixed contacts also having sides diverging from the ends of its flat top and engageable by the outer two contact bands.

7. An electric slide switch according to claim 6, in which only the inner eges of said outer two contact bands engage the diverging sides of the fixed contacts.

8. An electric side switch according to claim 6, in which the end portions of the shorting contact include substantially parallel sections integrally connecting the ends of said central body with said inclined legs, and said slots extend through said sections and into said inclined legs.

* * * * *